US012012251B2

(12) United States Patent
Daubenspeck et al.

(10) Patent No.: US 12,012,251 B2
(45) **Date of Patent: *Jun. 18, 2024**

(54) STACKABLE QUARTER-SIZE PLASTIC PLATFORM AND ASSOCIATED METHODS

(71) Applicant: CHEP Technology Pty Limited, Sydney (AU)

(72) Inventors: Bradley Wayne Daubenspeck, Windermere, FL (US); Nigel Sankar, Oakville (CA)

(73) Assignee: CHEP TECHNOLOGY PTY LIMITED, Sydney (AU)

( * ) Notice: Subject to any disclaimer, the term of this patent is extended or adjusted under 35 U.S.C. 154(b) by 0 days.

This patent is subject to a terminal disclaimer.

(21) Appl. No.: 18/323,848

(22) Filed: May 25, 2023

(65) Prior Publication Data

US 2023/0294872 A1 Sep. 21, 2023

Related U.S. Application Data

(63) Continuation of application No. 17/650,259, filed on Feb. 8, 2022, now Pat. No. 11,697,524.
(Continued)

(51) Int. Cl.
*B65D 19/38* (2006.01)
*B65D 19/00* (2006.01)
*B65D 19/40* (2006.01)

(52) U.S. Cl.
CPC ..... *B65D 19/385* (2013.01); *B65D 19/003* (2013.01); *B65D 19/40* (2013.01); *B65D 2519/0096* (2013.01)

(58) Field of Classification Search
CPC ..... B65D 19/003; B65D 19/40; B65D 2519/0096
See application file for complete search history.

(56) References Cited

U.S. PATENT DOCUMENTS 5,341,748 A * 8/1994 Liu ..... B65D 19/40 108/53.3
5,408,937 A 4/1995 Knight, IV et al.
(Continued)

FOREIGN PATENT DOCUMENTS

JP 4064651 B2 3/2008
KR 2018-0056350 A 5/2018
WO WO-2022135154 A1 * 6/2022

OTHER PUBLICATIONS

International Search Report and Written Opinion for International Application No. PCT/US2022/070573, dated May 6, 2022, (8 pages), United States Patent and Trademark Office, US.

*Primary Examiner* — Daniel J Rohrhoff
(74) *Attorney, Agent, or Firm* — Alston & Bird LLP

(57) ABSTRACT

A platform includes a top deck with spaced apart platform support leg openings extending therethrough, and platform support legs extending from a lower surface of the top deck and aligned with the platform support leg openings. Each platform support leg includes an upper portion and a lower portion, with the upper portion having an opening extending therethrough and aligned with a respective one of the platform support leg openings in the top deck. The lower portion includes a shelf that separates the opening in the upper portion from the lower portion. The shelf provides support to a bottom surface of a platform support leg from an identical platform when stacked thereon. A pair of extensions extend outwards from a bottom surface of the lower portion, with the opening in the upper portion providing clearance for the pair of extensions on the platform support leg of the identical platform when stacked thereon.

20 Claims, 11 Drawing Sheets

Related U.S. Application Data

(60) Provisional application No. 63/147,864, filed on Feb. 10, 2021.

(56) References Cited

U.S. PATENT DOCUMENTS

| | | | | |
|---|---|---|---|---|
| 5,606,921 | A | 3/1997 | Elder et al. | |
| 6,220,183 | B1 * | 4/2001 | Schwitzky | B65D 19/40 108/53.5 |
| 7,819,068 | B2 * | 10/2010 | Apps | B65D 19/0018 108/57.25 |
| 7,856,932 | B2 | 12/2010 | Stahl et al. | |
| 9,387,953 | B2 | 7/2016 | Takyar et al. | |
| 10,232,979 | B2 | 3/2019 | Takyar et al. | |
| 11,697,524 | B2 * | 7/2023 | Daubenspeck | B65D 19/004 108/53.1 |
| 2014/0000493 | A1 * | 1/2014 | Apps | B65D 19/38 29/428 |
| 2017/0297765 | A1 * | 10/2017 | Guerry | B65D 19/04 |
| 2021/0039830 | A1 * | 2/2021 | Kalinowski | B65D 19/004 |
| 2022/0250793 | A1 | 8/2022 | Daubenspeck et al. | |
| 2022/0289427 | A1 * | 9/2022 | Coubray | B65D 19/0065 |

* cited by examiner

STACKABLE QUARTER-SIZE PLASTIC PLATFORM AND ASSOCIATED METHODS

RELATED APPLICATION

This application is a continuation of U.S. Nonprovisional patent application Ser. No. 17/650,259, filed Feb. 8, 2022; which application further claims priority to and the benefit of U.S. Provisional Patent Application Ser. No. 63/147,864 filed Feb. 10, 2021; the contents of both of which as are hereby incorporated herein in their entireties by reference.

TECHNICAL FIELD

The present disclosure relates to the field of pallets, and more particularly, to a stackable quarter-size plastic platform.

BACKGROUND

Retail stores often prefer the use of fractional pallets when displaying products that are for customer purchase. Fractional pallets are typically one-quarter to one-half the size of full size pallets. Fractional pallets have a significantly smaller footprint, which allows retail stores to display a greater variety of products within the same size area as full size pallets.

In addition, retail stores often prefer the use of fractional plastic pallets instead of fractional wood pallets. Fractional plastic pallets are more aesthetically pleasing than fractional wood pallets, as well as being more sanitary.

Even in view of current fractional plastic pallets, there is still a need for such pallets that can be easily moved by pallet handling equipment, particularly without any products loaded thereon and when stacked with other fractional plastic pallets. When fractional plastic pallets are loaded with products to be transported, there is also a need to enable product display in retail stores that is aesthetically acceptable. Since the products to be carried by fractional plastic pallets at times may be relatively heavy, the load carrying capacity of the pallets should not be sacrificed while also providing accessibility.

SUMMARY

A platform includes a top deck that includes an upper surface and an opposing lower surface, with a plurality of spaced apart platform support leg openings extending through the upper and lower surfaces. A plurality of platform support legs extend from the lower surface of the top deck and are aligned with the plurality of platform support leg openings. Each platform support leg includes an upper portion and a lower portion.

The upper portion is adjacent the lower surface of the top deck and has an opening extending through a first pair of spaced apart sidewalls. The opening is aligned with a respective one of the platform support leg openings in the top deck. The lower portion is adjacent the upper portion and includes a shelf that separates the opening in the upper portion from the lower portion. The shelf is configured to provide support to a bottom surface of a platform support leg from an identical platform when stacked thereon. A pair of extensions extend outwards from a bottom surface of the lower portion, with the opening in the upper portion providing clearance for the pair of extensions on the platform support leg of the identical platform when stacked thereon.

The pair of extensions on the lower portion may be aligned with the opening in the upper portion of each platform support leg.

The pair of extensions on the lower portion may extend beyond a width of the opening in the upper portion of each platform support leg.

The pair of extensions on the identical platform when stacked thereon may extend beyond the width of the opening in the upper portion of each platform support leg.

The lower portion of each platform support leg may include a first pair of spaced apart sidewalls aligned with the first pair of spaced apart sidewalls in the upper portion, with both of the first pair of sidewalls having a tapered width toward the pair of extensions.

The upper and lower portions of each platform support leg may include a second pair of spaced apart sidewalls, with both of the second pair of sidewalls having a same width.

The shelf may extend between the bottom surface of the lower portion to the opening in the upper portion of each platform support leg. An upper surface of the shelf may include a ribbed structure.

Each platform support leg opening in the top deck may include a first pair of spaced apart sidewalls aligned with the first pair of spaced apart sidewalls in the upper portion of a corresponding platform support leg, and a second pair of spaced apart sidewalls adjacent the first pair of spaced apart sidewalls. The second pair of sidewalls may include spaced apart peaks extending into the platform support leg opening, with the peaks functioning as guides for when the corresponding platform support leg of the identical platform is stacked thereon.

The first pair of sidewalls are spaced apart to allow clearance for the pair of extension on the platform support leg of the identical platform when stacked thereon.

The upper and lower portions of each platform support leg may include a second pair of spaced apart sidewalls aligned with the second pair of spaced apart sidewalls in the platform support leg opening. The second pair of sidewalls may include spaced apart peaks extending outwards from the second pair of sidewalls. The spaced apart peaks may be staggered with respect to the pair of spaced apart peals in the platform support leg opening to function as guides for when the corresponding platform support leg of the identical platform is stacked thereon.

The top deck may include at least one product display attachment slot configured to receive a tab from at least one product display so as to allow the at least one product display to be held in place.

Another aspect is directed to method for making a platform as described above. The method includes forming a top deck that includes an upper surface and an opposing lower surface, with a plurality of spaced apart platform support leg openings extending through the upper and lower surfaces. The method further includes forming a plurality of platform support legs extending from the lower surface of the top deck and aligned with the plurality of platform support leg openings.

Each platform support leg includes an upper and lower portion. The upper portion adjacent the lower surface of the top deck and has an opening extending through a first pair of spaced apart sidewalls, with the opening aligned with a respective one of the platform support leg openings in the top deck. The lower portion is adjacent the upper portion and includes a shelf that separates the opening in the upper portion from the lower portion, with the shelf configured to provide support to a bottom surface of a platform support leg from an identical platform when stacked thereon. A pair of extensions extend outwards from a bottom surface of the lower portion, with the opening in the upper portion providing clearance for the pair of extensions on the platform support leg of the identical platform when stacked thereon.

DETAILED DESCRIPTION

The present description is made with reference to the accompanying drawings, in which exemplary embodiments are shown. However, many different embodiments may be used, and thus the description should not be construed as limited to the particular embodiments set forth herein. Rather, these embodiments are provided so that this disclosure will be thorough and complete. Like numbers refer to like elements throughout.

Figure 1:
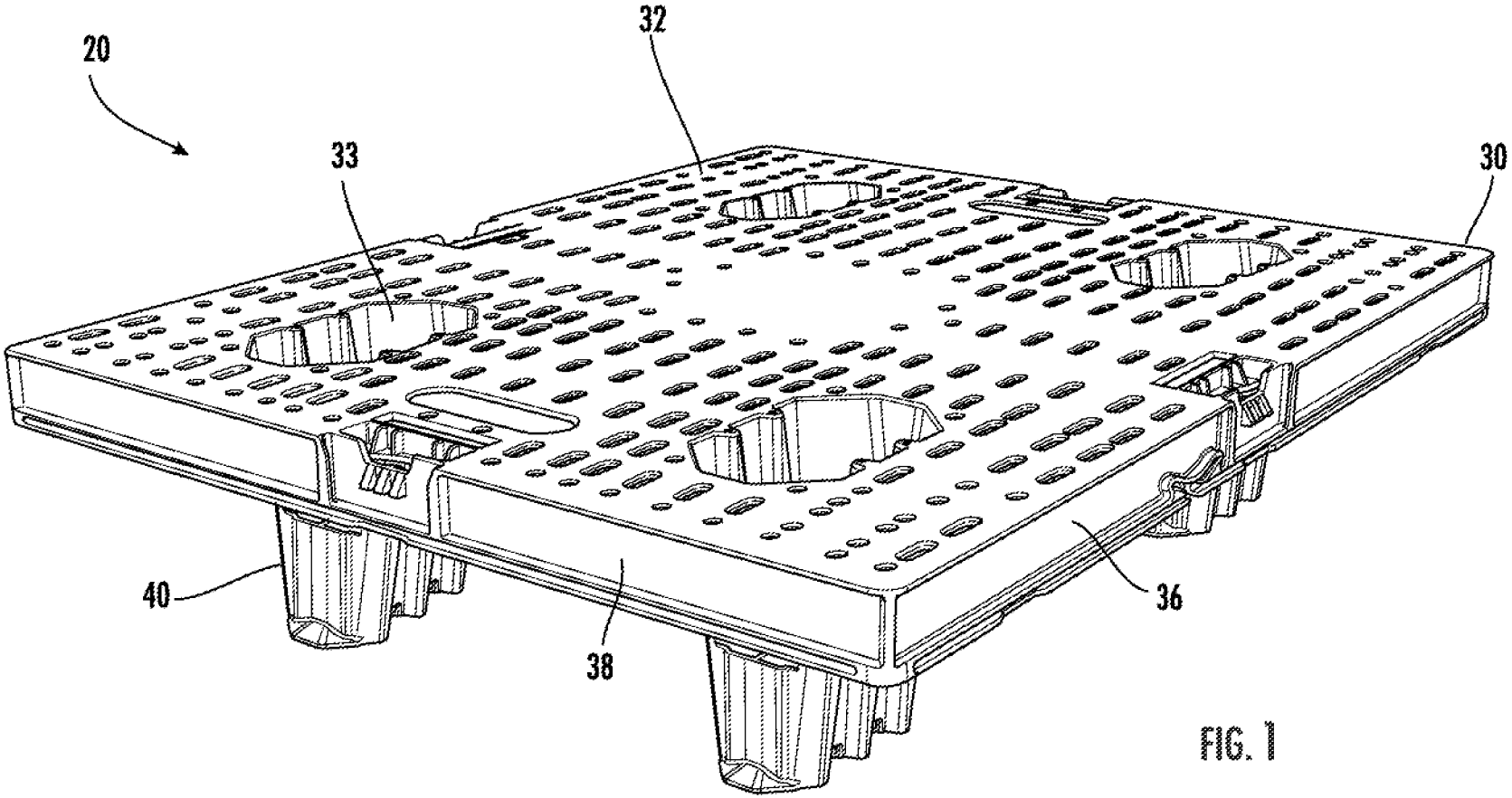
FIG. 1 is an upper perspective view of a quarter-size plastic platform in accordance with the disclosure.
Figure 2:
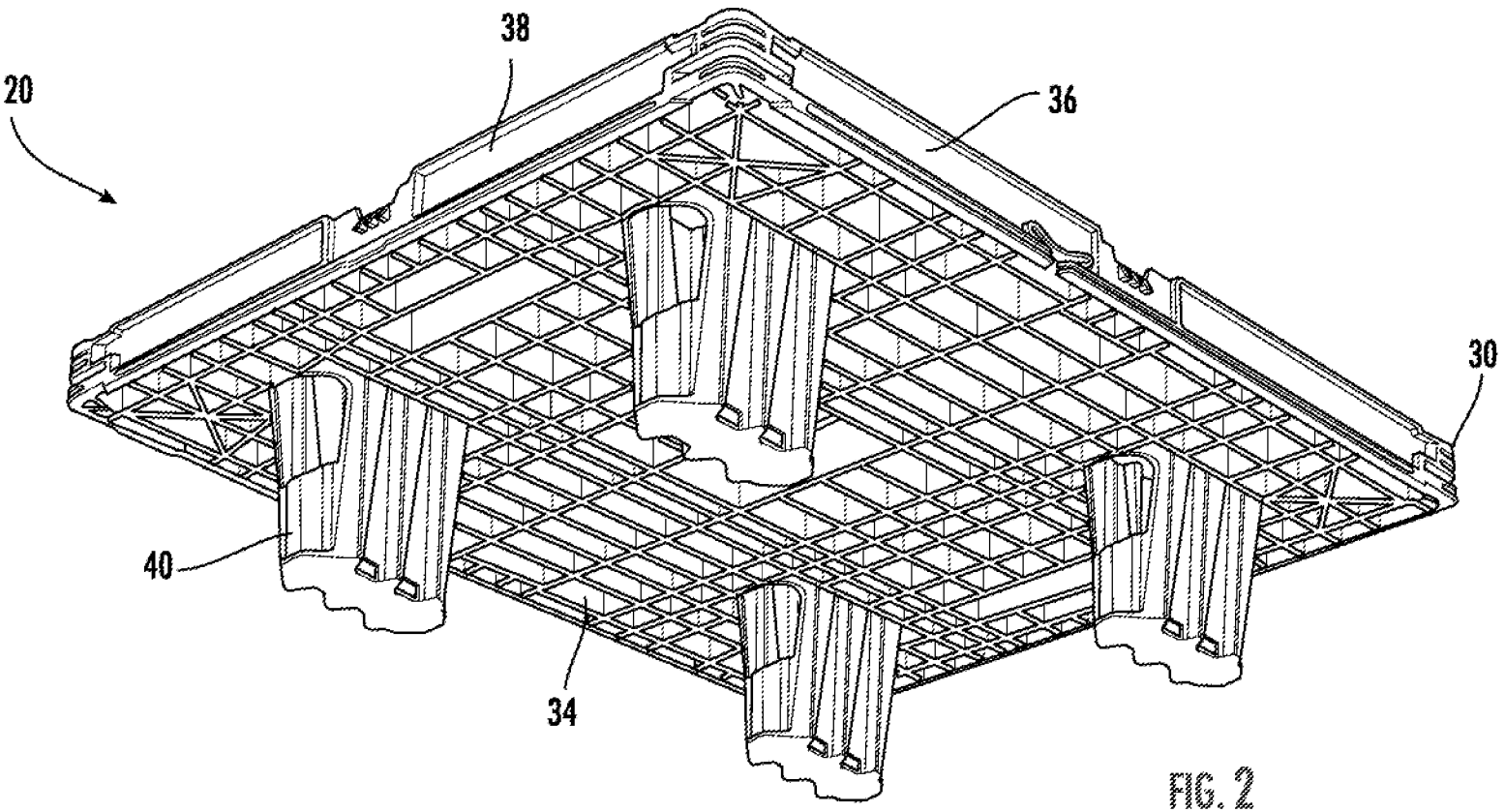
FIG. 2 is a lower perspective view of the quarter-size plastic platform shown in FIG. 1.

Referring initially to FIGS. 1 and 2, the illustrated plastic platform 20 includes a top deck 30 that has a plurality of spaced apart platform support leg openings 33 extending through upper and lower surfaces 32, 34 of the top deck 30. A plurality of platform support legs 40 extend from the lower surface 34 of the top deck, and are aligned with the plurality of platform support leg openings 33. The platform support leg openings 33 are configured to receive a bottom surface of a platform support leg 40 from an identical platform 20 when stacked thereon.

The plastic platform 20 may also be referred to as a quarter-size plastic platform due to its size as compared to a full-size pallet. A full-size pallet is 48 inches by 40 inches, whereas the quarter-size plastic platform 20 is 24 inches by 20 inches. Using the metric system, the quarter-size plastic platform 20 corresponds to 60.96 cm by 50.8 cm. In some cases, platform is interchangeable with pallet.

The quarter-size plastic platform 20 is designed for retail merchandising and display configurations, and provides a stable platform for a variety of display types. As will be discussed in detail below, the quarter-size plastic platform 20 includes product display attachment points. Since the quarter-size plastic platform 20 is intended to be placed on a retailer's floor space while displaying merchandise, the footprint of the quarter-size plastic platform 20 easily allows the retailer to position the plastic platforms 20 as needed within the aisles.

The upper surface 32 of the top deck 30 may be referred to as a product support surface, and the lower surface 34 may be referred to as an underside. The top deck 30 has outer exposed sides 36, 38 extending between the upper surface 32 and the lower surface 34. Outer sides 36 correspond to a length of the quarter-size plastic platform 20, and outer sides 38 correspond to a width or ends of the quarter-size plastic platform 20. The length is the longer dimension (i.e., 24 inches), with the width being the shorter dimension (i.e., 20 inches).

The platform support legs 40 are advantageously positioned on the lower surface 34 of the top deck 30 to support a load and to also enable two-way or four-way entry using multiple platform jack formats. Platform jack formats, for example, include a 27 inch forklift, a 21 inch hand jack, and electric platform jacks with 8 inch tines, 9 inch tines and 10 inch tines.

Figure 3:
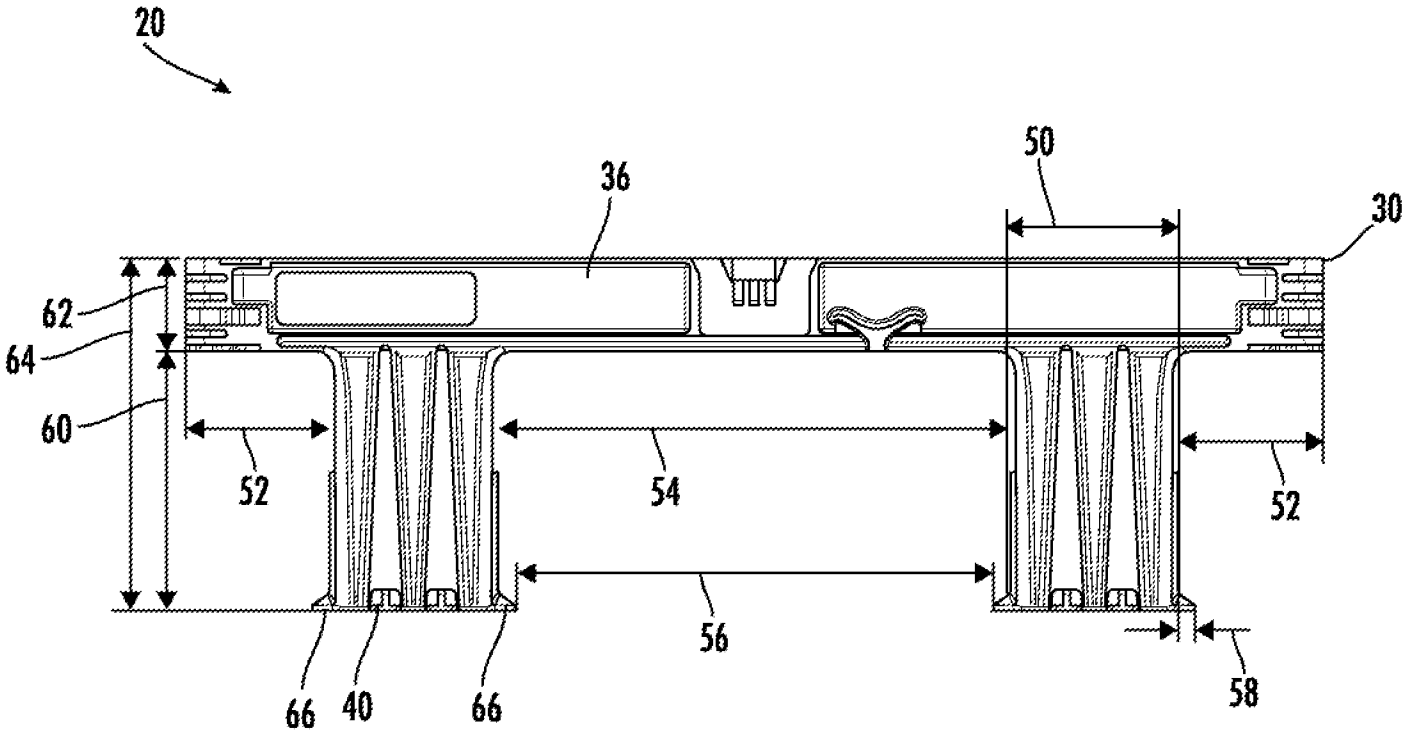
FIG. 3 is a side view with dimensions along a length of the quarter-size plastic platform shown in FIG. 1.

Dimensions and positioning of the platform support legs 40 will be now be discussed. The dimensions are provided for illustrative purposes and are not to be limiting. A side view of the plastic platform 20 along a length 36 is provided in FIG. 3. Each platform support leg 40 in this view has a consistent or non-tapered width of 3.56 inches, as indicated by reference 50. Each platform support leg 40 is spaced 3.04 inches from the ends of top deck 30, as indicated by references 52. The distance between the platform support legs 40 is 10.71 inches, as indicated by reference 54.

Still referring to the side view of the plastic platform 20 along the length 36, a height of each platform support leg 40 is 4.06 inches, as indicated by reference 60. A height of the top deck 30 is 1.46 inches, as indicated by reference 62. An overall height of the plastic platform 20 is 5.51 inches, as indicated by reference 64.

Each platform support leg 40 includes a lip or extension 66. Each extension 66 extends 0.36 inches outwards from the width of the platform support leg 40 in this view, as indicated by reference 58. The distance between the extensions 66 on a pair of platform support legs 40 is 9.99 inches, as indicated by reference 56. The extensions 66 advantageously increase the surface area of a lower or bottom surface of each platform support leg 40, which allows the plastic platform 20 to work better when placed on conveyors having wide gaps between rollers.

Figure 4:
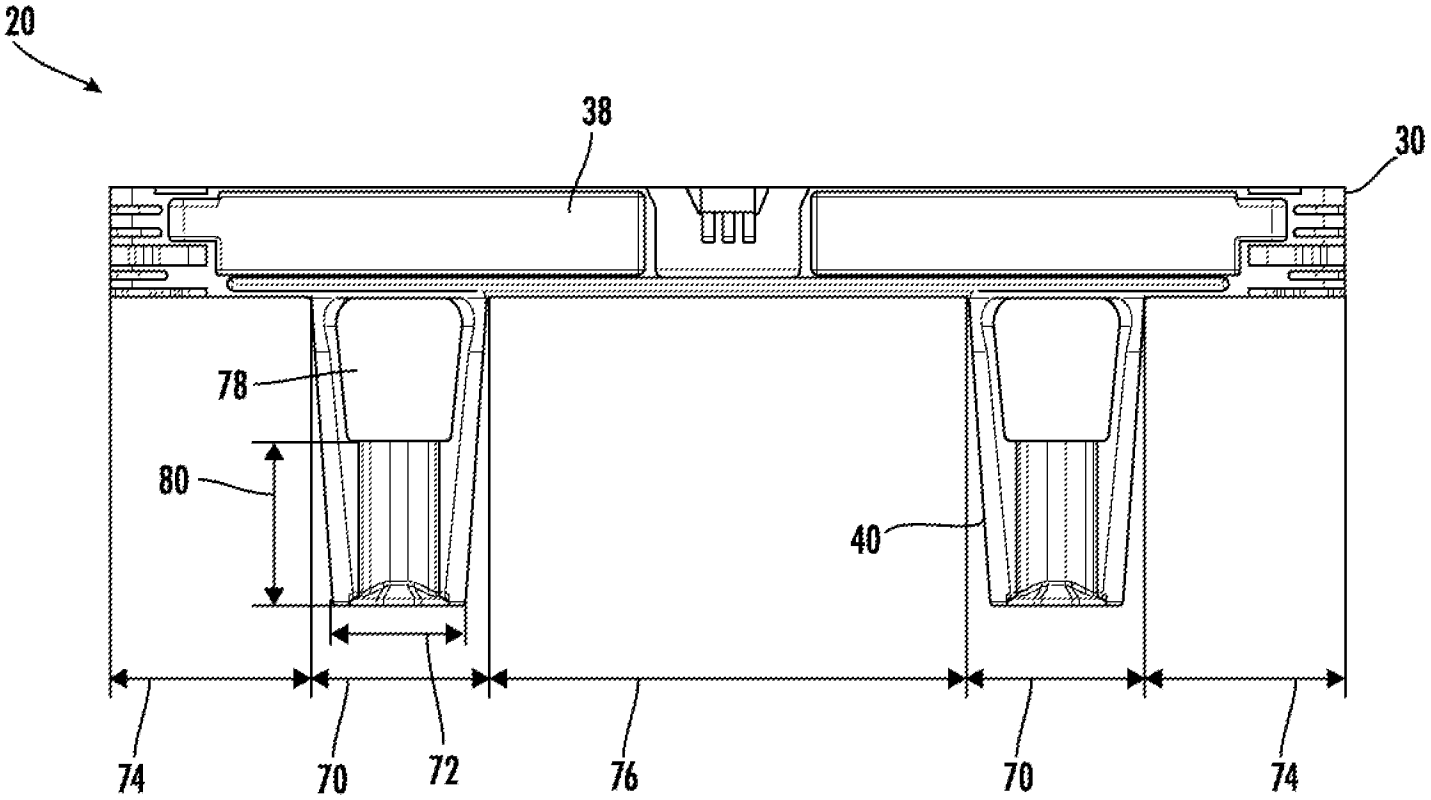
FIG. 4 is a side view with dimensions along a width of the quarter-size plastic platform shown in FIG. 1.

A side view of the plastic platform 20 along a width 38 is provided in FIG. 4. Each platform support leg 40 as shown in this view has a tapered width. The width of the platform support leg 40 extending from the top deck 30 starts off at 2.87 inches, as indicated by reference 70. The width of the platform support leg 40 then tapers to 2.15 inches, as indicated by reference 72. Each platform support leg 40 is spaced 3.25 inches from the sides of top deck 30, as indicated by references 74. The distance between the platform support legs 40 is 7.69 inches, as indicated by reference 76.

Figure 5:
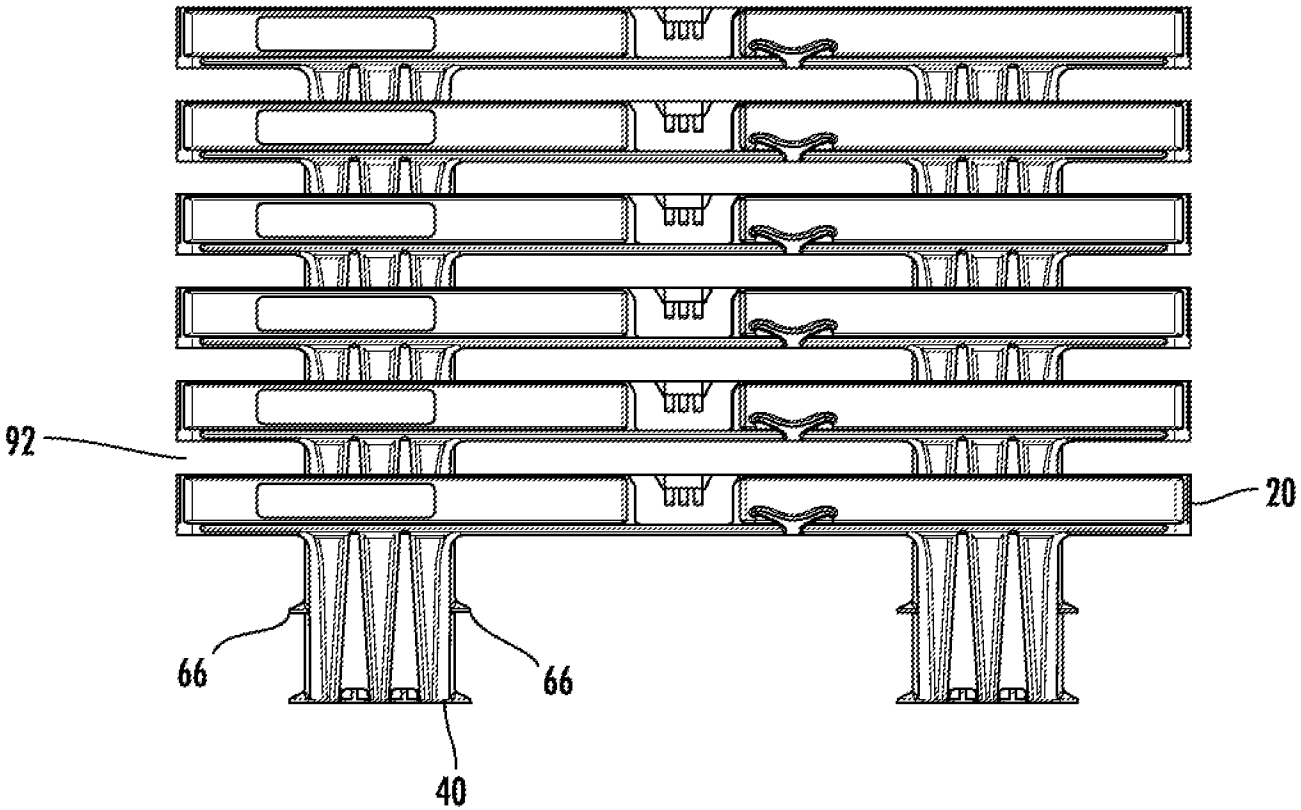
FIG. 5 is a side view with dimensions along a length of the quarter-size plastic platform shown in FIG. 1 stacked with other quarter-size plastic platforms.
Figure 7:
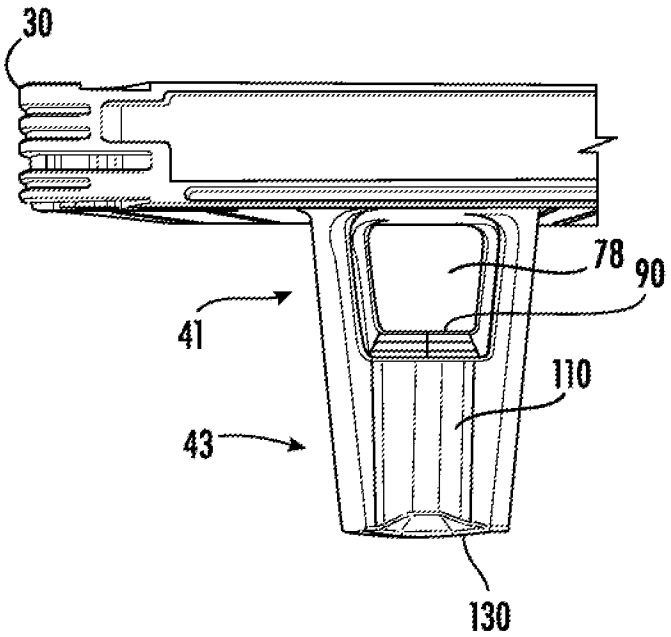
FIG. 7 is side view of a platform support leg along a width of the plastic platform shown in FIG. 1.

Still referring to the side view of the plastic platform 20 along the end 38, each platform support leg 40 includes an opening 78. The opening 78 is 2.17 inches above the bottom surface of each platform support leg 40, as indicated by reference 80. The openings 78 are needed when the plastic platforms 20 are stacked one on top of another, as illustrated in FIG. 5.

Each opening 78 provides clearance for the extensions 66 on the bottom surface of a platform support leg 40 of an identical platform when stacked thereon. As illustrated, the extensions 66 extend outwards from the openings 78. As will be described in detail below, a lower surface of each opening 78 includes a shelf or support structure to support the lower surface of a respective platform support leg 40 of an identical platform when stacked thereon.

An advantage of the shelf or support structure supporting the lower surface of a respective platform support leg 40 is that this allows for a gap 92 to be provided between the top decks 30 of the stacked platforms 20. The gaps 92 allow a person's fingers to be positioned between the stacked plastic platforms 20 for the plastic platforms 20 to be more easily separated. Another advantage of the shelf or support structure is that the platform support legs 40 are partially wedged in place when stacked on an underlying plastic platform 20, which also makes it easier for stacked platforms 20 to be separated.

Referring now to FIGS. 6-9, the platform support legs 40 will now be discussed in greater detail. Each platform support leg 40 includes an upper portion 41 and a lower portion 43. The upper portion 41 is adjacent the lower surface 34 of the top deck 30 and has an opening 78 extending through a first pair of spaced apart sidewalls 110. The opening 78 is aligned with a respective one of the platform support leg openings 33 in the top deck 30.

The lower portion 43 is adjacent the upper portion and includes a shelf 90 that separates the opening 78 in the upper portion 41 from the lower portion 43. The shelf 90 is configured to provide support to a bottom surface 130 of a platform support leg 40 from an identical platform 20 when stacked thereon. The pair of extensions 66 extend outwards from the bottom surface 130 of the lower portion 43, with the opening 78 in the upper portion 41 providing clearance for the pair of extensions 66 on the platform support leg 40 of the identical platform 20 when stacked thereon.

The pair of extensions 66 on the lower portion 43 are aligned with the opening 78 in the upper portion 41 of each platform support leg 40. The pair of extensions 66 extend beyond a width of the opening 78 in the upper portion 41 of each platform support leg 40. Consequently, the pair of extensions 66 on the identical platform 20 when stacked thereon extend beyond the width of the opening 78 in the upper portion 41 of each platform support leg 20, as shown in FIG. 5.

The lower portion 43 of each platform support leg 40 includes a pair of spaced apart sidewalls aligned with the first pair of spaced apart sidewalls 110 in the upper portion 41, with both pairs of sidewalls 110 having a tapered width toward the pair of extensions 66.

The upper and lower portions 41, 43 of each platform support leg 40 include a second pair of spaced apart sidewalls 100, with both of the second pair of sidewalls 100 having a same width.

The shelf 90 is adjacent the upper portion 41 of each platform support leg 40, and an upper surface of the shelf 90 includes a ribbed structure. The ribbed structure is defined by a pair of spaced apart ribs 122 and a divider 124 intersecting the pair of ribs 122, as shown in FIG. 8.

Figure 8:
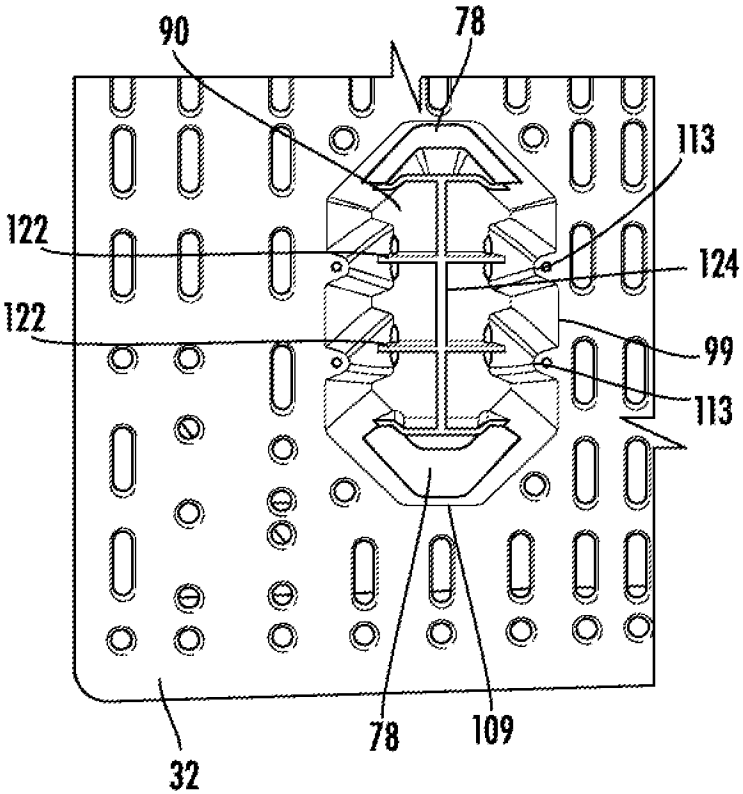
FIG. 8 is top view of one of the platform support legs of the plastic platform shown in FIG. 1.

Still referring to FIG. 8, each platform support leg opening 33 in the top deck 30 includes a first pair of spaced apart sidewalls 109 and a second pair of spaced apart sidewalls 99. The first pair of spaced apart sidewalls 109 are aligned with the first pair of spaced apart sidewalls 110 in the upper portion 41 of a corresponding platform support leg 40. The second pair of spaced apart sidewalls 99 are adjacent the first pair of spaced apart sidewalls 109, and are aligned with the second pair of spaced apart sidewalls 110 in the upper portion 41 of a corresponding platform support leg 40.

Each sidewall 99 includes spaced apart peaks 113 extending into the platform support leg opening 33. The peaks 113 function as guides for when the corresponding platform support leg 40 of the identical platform 20 is stacked thereon. Sidewalls 109 are spaced apart to allow clearance for the pair of extension 66 on the platform support leg 40 of the identical platform 20 when stacked thereon.

Figure 6:
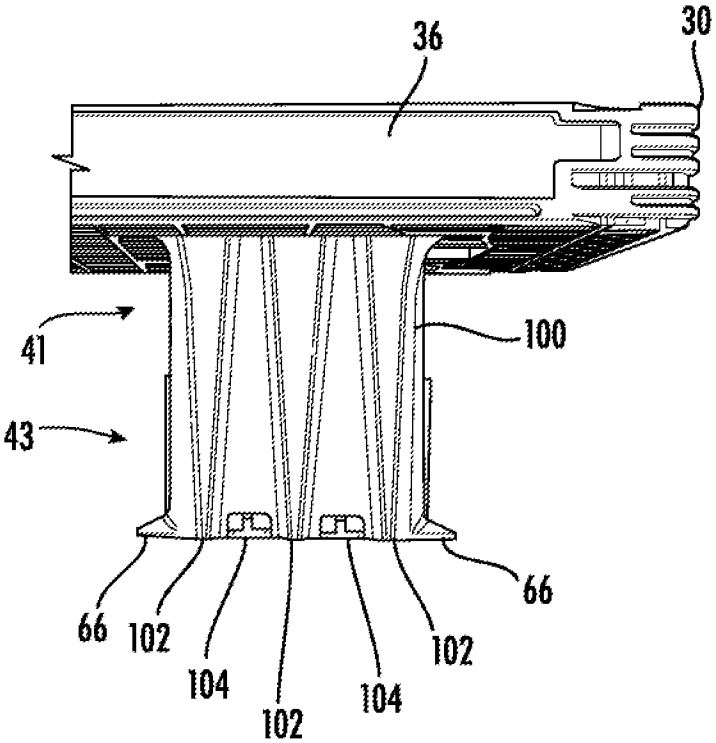
FIG. 6 is side view of a platform support leg along a length of the plastic platform shown in FIG. 1.
Figure 9:
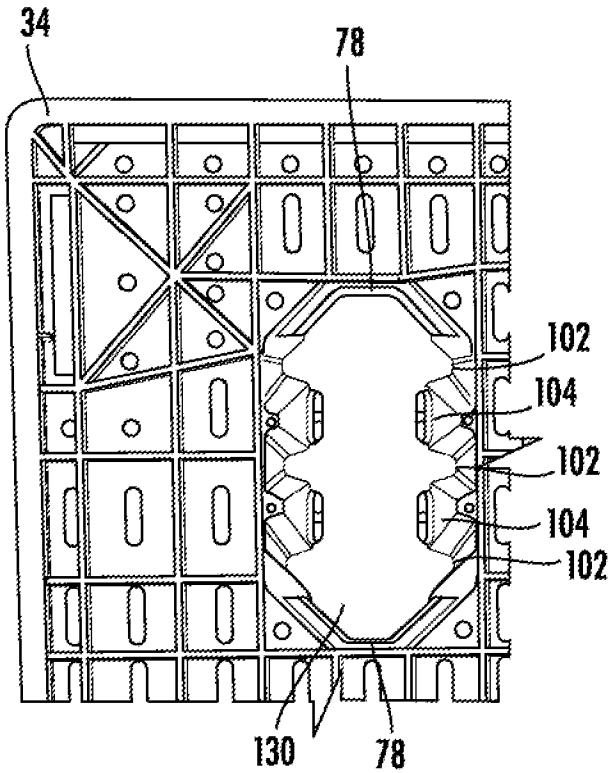
FIG. 9 is bottom view of one of the platform support legs of the plastic platform shown in FIG. 1.

The upper and lower portions 41, 43 of each platform support leg 40 include a second pair of spaced apart sidewalls 100 aligned with the second pair of spaced apart sidewalls 99 in the platform support leg opening 33. The second pair of sidewalls 100 include spaced apart peaks 102 extending outwards from the second pair of sidewalls 100, as shown in FIGS. 6 and 9.

The spaced apart peaks 102 are separated by valleys 104 and are staggered with respect to the pair of spaced apart peaks 113 in the platform support leg opening 33 to function as guides for when the corresponding platform support leg 40 of the identical platform 20 is stacked thereon. Also, the lower portion 43 of each platform support leg 40 includes drainage openings.

Other features of the plastic platform 20 will now be discussed in reference to FIGS. 10-13. These features include hand access holes, stretch wrap retention locations, banding retention guides, and product display attachment points.

Figure 10:
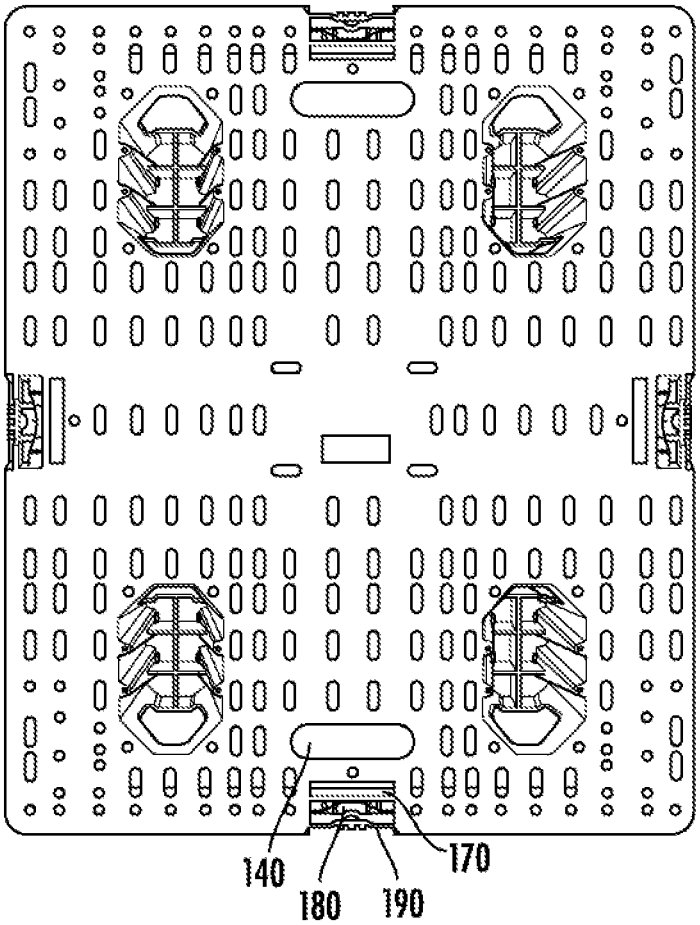
FIG. 10 is top view of the plastic platform shown in FIG. 1 with hand access holes and product display attachment points.

As illustrated in a top view of the top deck 30 in FIG. 10, a pair of hand access holes 140 are provided. The hand access holes 140 provide an easy means for an operator to handle the quarter-size plastic platform 20. Each hand access hole 140 is sized large enough for a user to insert all four fingers therethrough. By providing a hand access hole 140 near each end of the plastic platform 20, the quarter-size plastic platform 20 can very easily be grasped by the user for carrying it or for unloading it from a stack of platforms.

Figure 11:
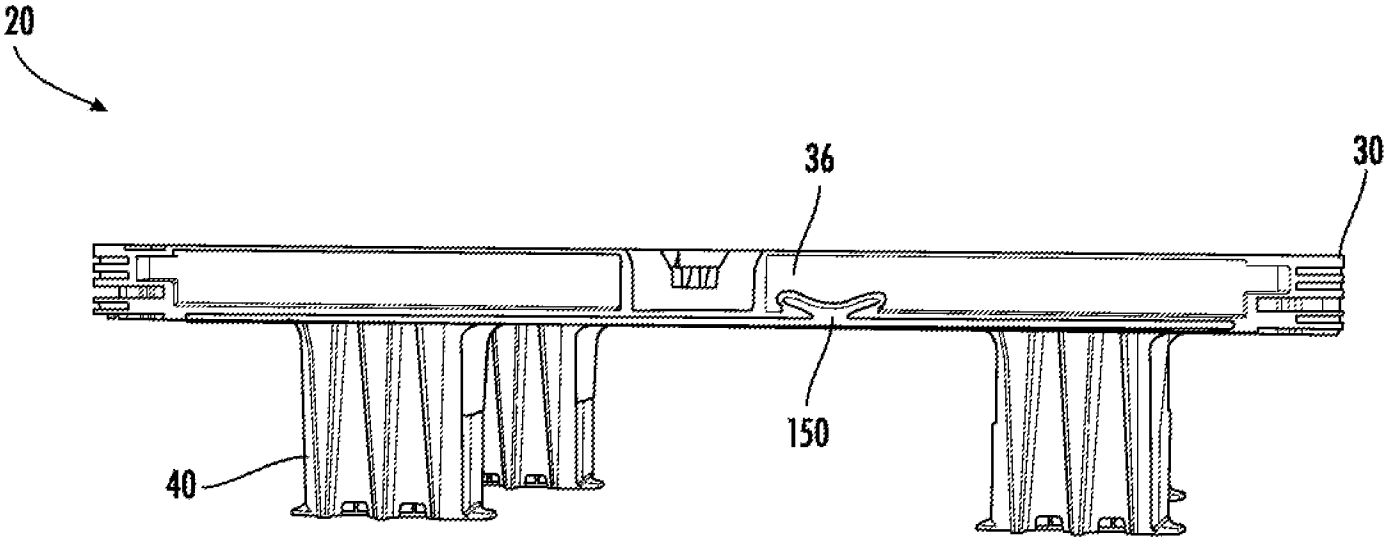
FIG. 11 is side view of the plastic platform shown in FIG. 1 with a shrink wrap retention location.

A shrink wrap retention location 150 is shown in the side view of the plastic platform 20 in FIG. 11. There is a respective shrink wrap retention location 150 on the length sides 36 of the plastic platform 20. The shrink wrap retention locations 150 are used in the application and retention of shrink wrap over a product being carried by the top deck 30. Shrink wrap is commonly used to secure a product to a platform. This is often an alternative to banding, although both can be applied if desired.

A problem encountered in applying shrink wrap to a platform is in securing the ends of the shrink wrap. This problem is encountered both at the start and the finish of shrink wrapping since the wrap might not want to adhere to the product or the platform, or may fail to retain itself against the product of the platform at the end.

Each shrink wrap retention location 150 takes the form of a two-sided groove, similar to the shape of an anvil. The two-sided groove has a front recess and a rear recess and a narrowed opening there between. The narrowed opening allows the shrink wrap to be located into the groove, but makes it harder for it to come out again. The wrap can be pulled into either the front or rear recesses and can secure an end of the wrap either at the start or at the end of the wrapping process.

The top deck 30 includes a number of different product display attachment points for securing a product display or box to the quarter-size plastic platform 20. When the quarter-size plastic platform 20 is on the floor within a store with products thereon, for example, a product display helps to promote the products. U.S. Pat. No. 9,387,953 discloses a fractional plastic pallet with product display attachment points, and is incorporated herein by reference in its entirety. The '953 patent is assigned to the current assignee of the present invention.

Figure 12:
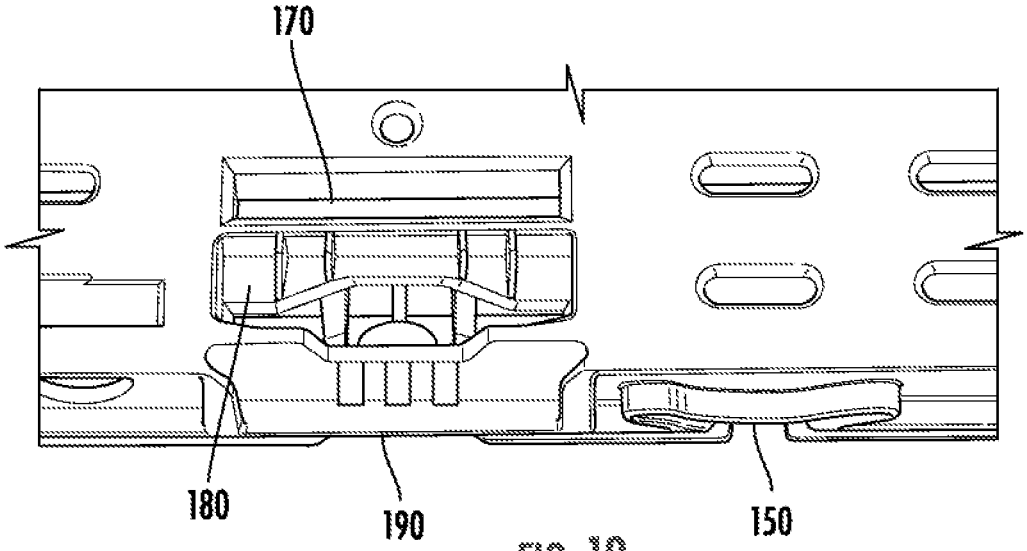
FIG. 12 is a perspective view of the product display attachment points on one side of the top deck shown in FIG. 10.
Figure 13:
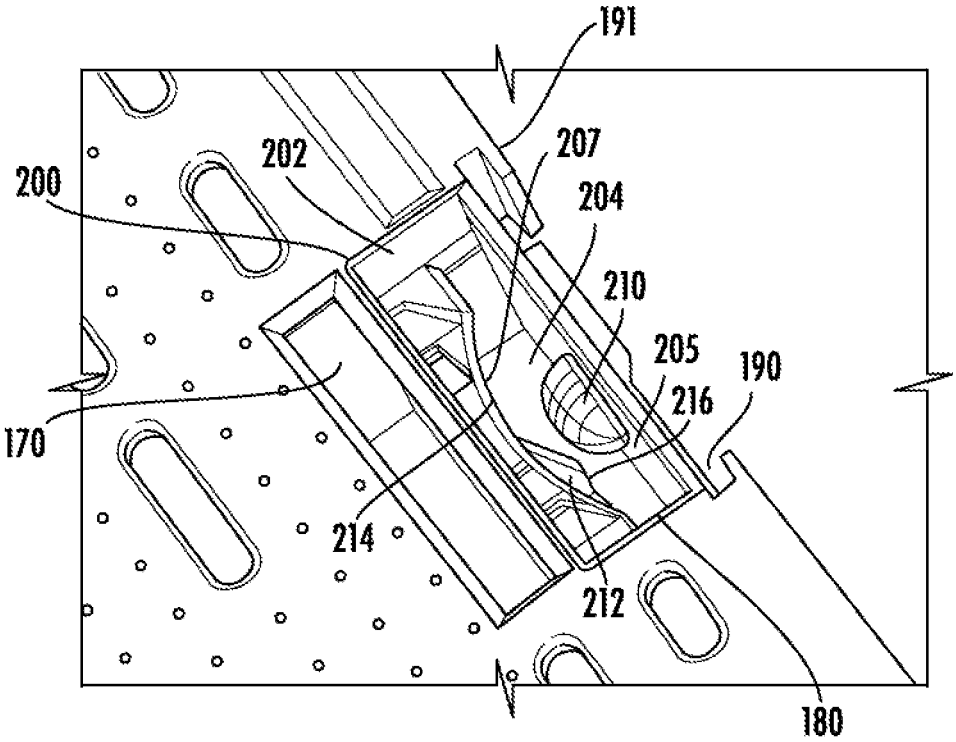
FIG. 13 is a more detailed perspective view of the product display attachment points shown in FIG. 12.

Product display attachment points include display attachment slots 170, 180 and 190 in the upper surface 32 of the top deck 30, as shown in FIGS. 10 and 12. Each display attachment slot 170, 180 and 190 is rectangular shaped and is sized to receive a tab descending from the base of product display so as to allow the product display to be held in place on the platform 20.

A pair display attachment slots 170 is located adjacent each side 36, 38 of the top deck 30, for four, There are also four display attachment slots 180 and four display attachment slots 190 in the top deck 30. Each display attachment slot 180 is aligned with a respective display attachment slot 170, and each display attachment slot 190 is recessed from a side 36, 38 of the top deck 30 and also aligned with a respective display attachment slot 180.

Still referring to FIGS. 10 and 12, each display attachment slot 180 includes an outer slot 200 within the to deck 30 and an inner slot 204 recessed within the outer slot. The outer slot 200 includes sides 202 and a partially closed bottom 214 forming a curved shelf. The inner slot 204 is adjacent the curved shelf 214 and is recessed below the outer slot 200. The inner slot 204 has a pair of spaced apart sidewalls 205 and 207, and a closed bottom 209.

Within the inner slot 204, sidewall 205 includes a projection 210 extending therefrom, and the opposing sidewall 207 includes a tapered member 216 extending therefrom. The tapered member 216 has a downwards taper towards the projection 210. If the product display tab has an appropriately positioned hole, that hole can engage and lock onto the project-ion 210 or the tapered member 216.

The sidewall 207 with the tapered member 216 is curved corresponding to the curved shelf 214, whereas the sidewall 205 with the projection 210 is not curved. The tapered member 216 includes a lowermost surface that is perpendicular to the closed bottom of the inner sot 204. There is a gap between the flat underside and the closed bottom. The projection 210 has a quarter-spherical shape, for example. The tapered member 216 is aligned with a center of the projection 210.

Each display attachment slot 190 is recessed from a side 36, 38 of the top deck 30. A significant portion of the corresponding sides 36, 38 of the top deck 30 is removed so as to expose the display attachment slot 190. Removal of the corresponding sides 36, 38 for the display attachment slots 190 is uniform so as to form a pair of spaced apart retention tabs 191 for securing a product display tab. The retention tabs 191 are at an upper portion of the display attachment slot 190, while the lower portion of the display attachment slot 190 is fully exposed.

Many modifications and other embodiments will come to the mind of one skilled in the art having the benefit of the teachings presented in the foregoing descriptions and the associated drawings. Therefore, it is understood that the disclosure is not to be limited to the specific embodiments disclosed, and that modifications and embodiments are intended to be included within the scope of the disclosure.

The invention claimed is:

1. A platform comprising:

a top deck that includes an upper surface and an opposing lower surface, with a plurality of spaced apart platform support leg openings extending through the upper and lower surfaces; and a plurality of platform support legs extending from the lower surface of said top deck and aligned with the plurality of platform support leg openings, each platform support leg comprising:

an upper portion adjacent the lower surface of said top deck and having an opening extending through a first pair of spaced apart sidewalls, and a lower portion adjacent the upper portion and including a pair of extensions extending outwards from a bottom surface of the lower portion, with the opening in the upper portion providing clearance for the pair of extensions on the platform support leg of the identical platform when stacked thereon.

2. The platform according to claim 1, wherein said pair of extensions on the lower portion is aligned with the opening in the upper portion of each platform support leg.

3. The platform according to claim 1, wherein said pair of extensions on the lower portion extend beyond a width of the opening in the upper portion of each platform support leg.

4. The platform according to claim 3, wherein the pair of extensions on the identical platform when stacked thereon extend beyond the width of the opening in the upper portion of each platform support leg.

5. The platform according to claim 1, wherein the lower portion of each platform support leg includes a first pair of spaced apart sidewalls aligned with the first pair of spaced apart sidewalls in the upper portion, with both of the first pair of sidewalls having a tapered width toward said pair of extensions.

6. The platform according to claim 1, wherein the upper and lower portions of each platform support leg include a second pair of spaced apart sidewalls, with both of the second pair of sidewalls having a same width.

7. The platform according to claim 1, wherein:

the lower portion further includes a shelf that separates the opening in the upper portion from the lower portion, with the shelf configured to provide support to a bottom surface of a platform support leg from an identical platform when stacked thereon; and at least one of:

said shelf extends between the bottom surface of the lower portion to the opening in the upper portion of each platform support leg; or an upper surface of said shelf includes a ribbed structure.

8. The platform according to claim 1, wherein the opening extending through the first pair of spaced apart sidewalls is aligned with a respective one of the platform support leg openings in said top deck.

9. The platform according to claim 1, wherein each platform support leg opening in said top deck includes the following:

a first pair of spaced apart sidewalls aligned with the first pair of spaced apart sidewalls in the upper portion of a corresponding platform support leg; and a second pair of spaced apart sidewalls adjacent the first pair of spaced apart sidewalls, with the second pair of sidewalls including spaced apart peaks extending into the platform support leg opening, with the peaks functioning as guides for when the corresponding platform support leg of the identical platform is stacked thereon.

10. The platform according to claim 9, wherein the first pair of sidewalls are spaced apart to allow clearance for the pair of extension on the platform support leg of the identical platform when stacked thereon.

11. The platform according to claim 9, wherein the upper and lower portions of each platform support leg include a second pair of spaced apart sidewalls aligned with the second pair of spaced apart sidewalls in the platform support leg opening, with the second pair of sidewalls including spaced apart peaks extending outwards from the second pair of sidewalls, with the spaced apart peaks being staggered with respect to the pair of spaced apart peals in the platform support leg opening to function as guides for when the corresponding platform support leg of the identical platform is stacked thereon.

12. The platform according to claim 1, wherein said top deck includes at least one product display attachment slot configured to receive a tab from at least one product display so as to allow the at least one product display to be held in place.

13. A method for making a platform comprising:

forming a top deck that includes an upper surface and an opposing lower surface, with a plurality of spaced apart platform support leg openings extending through the upper and lower surfaces; and forming a plurality of platform support legs extending from the lower surface of the top deck and aligned with the plurality of platform support leg openings, each platform support leg comprising:

an upper portion adjacent the lower surface of the top deck and having an opening extending through a first pair of spaced apart sidewalls, and a lower portion adjacent the upper portion and including a pair of extensions extending outwards from a bottom surface of the lower portion, with the opening in the upper portion providing clearance for the pair of extensions on the platform support leg of the identical platform when stacked thereon.

14. The method according to claim 13, wherein the pair of extensions on the lower portion is aligned with the opening in the upper portion of each platform support leg.

15. The method according to claim 13, wherein the pair of extensions on the lower portion extend beyond a width of the opening in the upper portion of each platform support leg.

16. The method according to claim 15, wherein the pair of extensions on the identical platform when stacked thereon extend beyond the width of the opening in the upper portion of each platform support leg.

17. The method according to claim 13, wherein the lower portion of each platform support leg includes a first pair of spaced apart sidewalls aligned with the first pair of spaced apart sidewalls in the upper portion, with both of the first pair of sidewalls having a same width, with both of the first pair of sidewalls having a tapered width toward said pair of extensions.

18. The method according to claim 13, wherein the upper and lower portions of each platform support leg include a second pair of spaced apart sidewalls, with both of the second pair of sidewalls having a same width.

19. The method according to claim 13 wherein:

the lower portion further includes a shelf that separates the opening in the upper portion from the lower portion, with the shelf configured to provide support to a bottom surface of a platform support leg from an identical platform when stacked thereon; and at least one of:

said shelf extends between the bottom surface of the lower portion to the opening in the upper portion of each platform support leg; or an upper surface of said shelf includes a ribbed structure.

20. The method according to claim 13 wherein the opening extending through the first pair of spaced apart sidewalls is aligned with a respective one of the platform support leg openings in said top deck.

* * * * *